US009549656B2

(12) United States Patent
Milanese et al.

(10) Patent No.: US 9,549,656 B2
(45) Date of Patent: Jan. 24, 2017

(54) HOT CLEANING SYSTEM FOR SURFACES

(71) Applicant: Pier Antonio Milanese, Susegana (IT)

(72) Inventors: Pier Antonio Milanese, Susegana (IT); Andrea Milanese, Conegliano (IT)

( * ) Notice: Subject to any disclaimer, the term of this patent is extended or adjusted under 35 U.S.C. 154(b) by 69 days.

(21) Appl. No.: 14/726,363

(22) Filed: May 29, 2015

(65) Prior Publication Data

US 2016/0100735 A1 Apr. 14, 2016

Related U.S. Application Data

(63) Continuation-in-part of application No. 14/510,258, filed on Oct. 9, 2014.

(60) Provisional application No. 62/148,306, filed on Apr. 16, 2015.

(51) Int. Cl.

| | |
|---|---|
| ***A47L 13/26*** | (2006.01) |
| ***A47L 11/34*** | (2006.01) |
| ***A47L 11/40*** | (2006.01) |
| ***A47L 13/16*** | (2006.01) |
| ***A47L 13/22*** | (2006.01) |

(52) U.S. Cl.

CPC ..... *A47L 13/26* (2013.01); *A47L 11/34* (2013.01); *A47L 11/408* (2013.01); *A47L 11/4075* (2013.01); *A47L 11/4086* (2013.01); *A47L 11/4088* (2013.01); *A47L 13/16* (2013.01); *A47L 13/225* (2013.01)

(58) Field of Classification Search

CPC A47L 11/408; A47L 11/4086; A47L 11/4088; A47L 13/22; A47L 13/30; A47L 13/312; A47L 13/316; A47L 13/32

See application file for complete search history.

(56) References Cited

U.S. PATENT DOCUMENTS

| | | | | |
|---|---|---|---|---|
| 2,089,911 | A * | 8/1937 | Replogle | A47L 13/32 15/320 |
| 3,907,177 | A * | 9/1975 | Levin | B65D 47/0833 222/500 |
| 4,312,598 | A * | 1/1982 | Vagner | A47L 13/26 401/1 |
| 5,587,021 | A | 12/1996 | Hoersch | |
| 5,920,952 | A | 7/1999 | Baldacci | |
| 6,289,551 | B1 | 9/2001 | Basile | |
| 6,584,990 | B2 | 7/2003 | Shaw | |

(Continued)

FOREIGN PATENT DOCUMENTS

| | | |
|---|---|---|
| EP | 0842631 A1 | 5/1998 |
| EP | 1795109 A2 | 6/2007 |

*Primary Examiner* — Jennifer C Chiang
*Assistant Examiner* — Bradley Oliver
(74) *Attorney, Agent, or Firm* — Frank Marino

(57) ABSTRACT

An apparatus for horizontal surface cleaning includes a cleaning head for engaging horizontal surfaces to be cleaned, a handle pivotally engaging the cleaning head for grasping during horizontal surface cleaning, and a tank affixed to the handle and pivotal therewith relative to the cleaning head. The tank is adapted to contain a surface cleaning liquid. The handle and tank have together an upright orientation during storage and a tilted orientation during horizontal surface cleaning. The tank includes a valve that closes during the upright orientation to prevent the liquid from exiting the tank, and opens during the tilted orientation to allow the liquid to exit the tank. The tilted orientation is caused during horizontal surface cleaning.

13 Claims, 13 Drawing Sheets

(56) References Cited

U.S. PATENT DOCUMENTS

| | | | | |
|---|---|---|---|---|
| 7,380,307 | B2 | 6/2008 | Tsai | |
| 7,930,798 | B2 | 4/2011 | Zhou et al. | |
| 8,171,592 | B2 | 5/2012 | Tsai | |
| 8,205,293 | B2 | 6/2012 | Rosenzweig et al. | |
| 8,353,074 | B2 | 1/2013 | Krebs | |
| 8,534,301 | B2 | 9/2013 | Nottingham et al. | |
| 2002/0066153 | A1* | 6/2002 | Sclafani | A47L 7/0009 15/347 |
| 2004/0031506 | A1 | 2/2004 | Tsai | |
| 2007/0209139 | A1 | 9/2007 | Carlucci et al. | |
| 2008/0236635 | A1 | 10/2008 | Rosenzweig et al. | |
| 2009/0320231 | A1 | 12/2009 | Rosenzweig et al. | |
| 2010/0050367 | A1* | 3/2010 | Tsai | A47L 13/225 15/320 |
| 2013/0318725 | A1* | 12/2013 | Kellis | A47L 11/34 8/137 |
| 2014/0245555 | A1* | 9/2014 | Thorne | B25G 1/06 15/228 |

* cited by examiner

HOT CLEANING SYSTEM FOR SURFACES

RELATED APPLICATION

This application is a Continuation-in-Part of U.S. application Ser. No. 14/510,258, filed on 9 Oct. 2014, and is a formalization of U.S. Provisional App No. 62/148,306 filed on 16 Apr. 2015. The entire teachings of both are incorporated herein by reference in their entireties.

FIELD OF THE INVENTION

This invention is related to surface cleaning devices in general and in particular to systems and apparatuses for the hot wet or dry cleaning of surfaces such as floors.

BACKGROUND

The invention may be embodied by or practiced using an apparatus for the cleaning of surfaces, having a power cord detachable from the apparatus, a cleaning head having a heating plate, and a cleaning pad, wherein the heating plate forms a planar underside of the cleaning head and includes a heating element to heat the planar underside when the power cord energizes the heating element. The cleaning pad may be removably attached against and in thermal communication with the planar underside such that the cleaning pad is heated to a temperature between 85 C and 100 C, inclusive, when the power cord energizes the heating element. And the heating element may not heat the planar underside and the cleaning pad may not be heated whenever the power cord is detached from the apparatus. The cleaning pad may be a pre-moistened fabric pad.

This apparatus may further have a cleaning head including the heating plate and the cleaning pad, and an elongate body having a handle at a proximal end thereof, wherein the cleaning head may be flexibly disposed at a distal end of the elongate body.

The invention may alternatively be embodied by or practiced using an apparatus for the hot and moist cleaning of surfaces, having a water reservoir, and a cleaning head having a heating plate and a cleaning pad, wherein the heating plate forms a planar underside of the cleaning head and includes a heating element to heat the planar underside. The water reservoir may be adapted to moisten the cleaning pad when the planar underside is above approximately 85 C. The cleaning pad may be removably attached against and in thermal communication with the planar underside such that the cleaning pad is moistened and heated to a temperature between 85 C and 100 C, inclusive. And the heating plate may not substantially heat water from the water reservoir prior to the moistening of the cleaning pad.

This alternative apparatus may further have a thermally-actuated valve to control the moistening of the cleaning pad by the water reservoir. The thermally actuated valve may be configured to open at approximately 85 C or above to allow water from the water reservoir to the cleaning pad. The thermally actuated valve may have a valve stem having an open position for allowing water from the water reservoir to the cleaning pad, and a closed position for denying water from the water reservoir to the cleaning pad, and a bimetal actuator which changes shape according to temperature change and moves the valve stem between the open and closed positions accordingly.

This alternative apparatus may further have an elongate body including a handle at a proximal end thereof, wherein the cleaning head is flexibly disposed at a distal end of the elongate body. The water reservoir may be disposed on the elongate body above the cleaning head, and may be adapted to moisten the cleaning pad by gravitational force when the valve stem is in the open position.

This alternative apparatus may further have a thermostat electrically connected to the heating element and adapted for sensing the temperature of the planar underside to maintain the temperature of the cleaning pad between 85 C and 100 C, inclusive.

This alternative apparatus may further have a thermo-fuse electrically connected to the heating element and adapted for sensing the temperature of the planar underside to disable the apparatus when an abnormally high temperature is sensed.

Additionally, the invention may alternatively be embodied by or practiced using an apparatus for the hot and moist cleaning of floors having an elongate body including a handle at a proximal end thereof and a water reservoir; and a cleaning head flexibly disposed at a distal end of the elongate body and having a heating plate and a cleaning pad, wherein the heating plate forms a planar underside of the cleaning head and includes a heating element to heat the planar underside. The water reservoir may be adapted to moisten the cleaning pad when the planar underside is above 85 C. The cleaning pad may be removably attached against and in thermal communication with the planar underside such that the cleaning pad is moistened and heated to a temperature between 85 C and 100 C, inclusive. And the heating plate may not substantially heat water from the water reservoir prior to the moistening of the cleaning pad.

This additionally alternative apparatus may further have a thermally-actuated valve to control the moistening of the cleaning pad by the water reservoir. The thermally actuated valve may be configured to open at approximately 85 C or above to allow water from the water reservoir to the cleaning pad. The thermally actuated valve may have a valve stem having an open position for allowing water from the water reservoir to the cleaning pad, and a closed position for denying water from the water reservoir to the cleaning pad, and a bimetal actuator which changes shape according to temperature change and moves the valve stem between the open and closed positions accordingly. The water reservoir may be disposed on the elongate body above the cleaning head, and may be adapted to moisten the cleaning pad by gravitational force when the valve stem is in the open position.

This additionally alternative apparatus may further have a thermostat electrically connected to the heating element and adapted for sensing the temperature of the planar underside to maintain the temperature of the cleaning pad between 85 C and 100 C, inclusive.

This additionally alternative apparatus may further have a thermo-fuse electrically connected to the heating element and adapted for sensing the temperature of the planar underside to disable the apparatus when an abnormally high temperature is sensed. This additionally alternative apparatus may further have a trigger-actuated valve in fluid communication with the water reservoir and thermally-actuated valve to selectively allow or deny water from the water reservoir to the thermally-actuated valve.

The invention may also be embodied by or practiced using an apparatus for horizontal surface cleaning having; a tank adapted for containing a surface cleaning liquid and having an upright orientation during storage and a tilted orientation during horizontal surface cleaning, and a gravity-actuated valve cooperating with the tank to prevent the liquid from exiting the tank during the upright orientation and allowing the liquid to exit the tank during the tilted orientation. The horizontal surface cleaning may require the tank to assume the tilted orientation. The apparatus may include a power cord detachable from the apparatus, a cleaning head having a heating plate, and a cleaning pad; wherein the heating plate forms a planar underside of the cleaning head and includes a heating element to heat the planar underside when the power cord energizes the heating element. The cleaning pad may be removably attached against and in thermal communication with the planar underside such that the cleaning pad is heated to a temperature between 85 C and 100 C, inclusive, when the power cord energizes the heating element, and the heating element may not heat the planar underside and the cleaning pad is not heated whenever the power cord is detached from the apparatus.

The cleaning pad may be fabric pad. The cleaning head may include the heating plate and the cleaning pad. The apparatus may further include an elongate body having a handle at a proximal end thereof, wherein the cleaning head is flexibly disposed at a distal end of the elongate body, and wherein the elongate body is tilted during horizontal surface cleaning.

The invention may also be embodied by or practiced using an apparatus for horizontal surface cleaning having a cleaning head for engaging horizontal surfaces to be cleaned, a handle pivotally engaging the cleaning head for grasping during horizontal surface cleaning, and a tank affixed to the handle and pivotal therewith relative to the cleaning head, the tank adapted to contain a surface cleaning liquid. The handle and tank may have together an upright orientation during storage and a tilted orientation during horizontal surface cleaning, and the tank may include a valve that closes during the upright orientation to prevent the liquid from exiting the tank, and opens during the tilted orientation to allow the liquid to exit the tank. The tilted orientation may be caused during horizontal surface cleaning.

The cleaning head may include a heating plate and a cleaning pad; wherein the heating plate forms a planar underside of the cleaning head and includes a heating element to heat the planar underside. The tank may be adapted to selectively moisten the cleaning pad when the planar underside is above approximately 85 C. The cleaning pad may be removably attached against and in thermal communication with the planar underside such that the cleaning pad is moistened and heated to a temperature between 85 C and 100 C, inclusive. And the heating plate may not substantially heat water from the tank prior to the moistening of the cleaning pad. A thermally-actuated valve may control the moistening of the cleaning pad by the tank. The thermally actuated valve may be configured to open at approximately 85 C or above to allow water from the tank to the cleaning pad. The thermally actuated valve may include a valve stem having an open position for allowing water from the tank to the cleaning pad, and a closed position for denying water from the tank to the cleaning pad, and a bimetal actuator which changes shape according to temperature change and moves the valve stem between the open and closed positions accordingly.

An elongate body may include the handle at a proximal end thereof, wherein the cleaning head is flexibly disposed at a distal end of the elongate body. The tank may be disposed on the elongate body above the cleaning head, and may be adapted to moisten the cleaning pad by gravitational force when the valve stem is in the open position and the tank and handle are in the tilted orientation. A thermostat may be electrically connected to the heating element and adapted for sensing the temperature of the planar underside to maintain the temperature of the cleaning pad between 85 C and 100 C, inclusive. A thermo-fuse may be electrically connected to the heating element and adapted for sensing the temperature of the planar underside to disable the apparatus when an abnormally high temperature is sensed.

The invention may also be embodied by or practiced using an apparatus for floor cleaning, having an underside having a perimeter edge, a cleaning pad, and fasteners for affixing the cleaning pad to the underside. The cleaning pad may include a main portion for floor cleaning and a tab extending there-from beyond the perimeter edge when the cleaning pad is affixed to the underside, for engaging to remove the cleaning pad from the underside without engaging the main portion. The apparatus may be adapted to wet the main portion of the cleaning pad during floor cleaning and the tab may be of a non-absorbent material which remains dry when the main portion is moistened. The fasteners may be hook/loop fasteners affixed to the underside and the main portion may include hook/loop fabric.

The invention may also be embodied by or practiced using a cleaning pad for an apparatus for floor cleaning, the apparatus of the type having an underside having a perimeter edge and fasteners for affixing the cleaning pad to the underside. The cleaning pad may include a main portion for floor cleaning and a tab extending there-from beyond the perimeter edge when the cleaning pad is affixed to the underside, for engaging to remove the cleaning pad from the underside without engaging the main portion. The tab may be of a non-absorbent material which remains dry if the main portion is moistened. The fasteners of the apparatus may be hook/loop fasteners affixed to the underside, and the main portion may include hook/loop fabric.

Further features and aspects of the invention are disclosed with more specificity in the Detailed Description and Drawings provided herein and showing exemplary embodiments of the invention.

BRIEF DESCRIPTION OF THE DRAWINGS

As an explanation, without limitations, of the characteristics of this invention, an example of realisation of the system is now described with reference to the drawings enclosed.

DETAILED DESCRIPTION OF EXEMPLARY EMBODIMENTS

Figure 1:
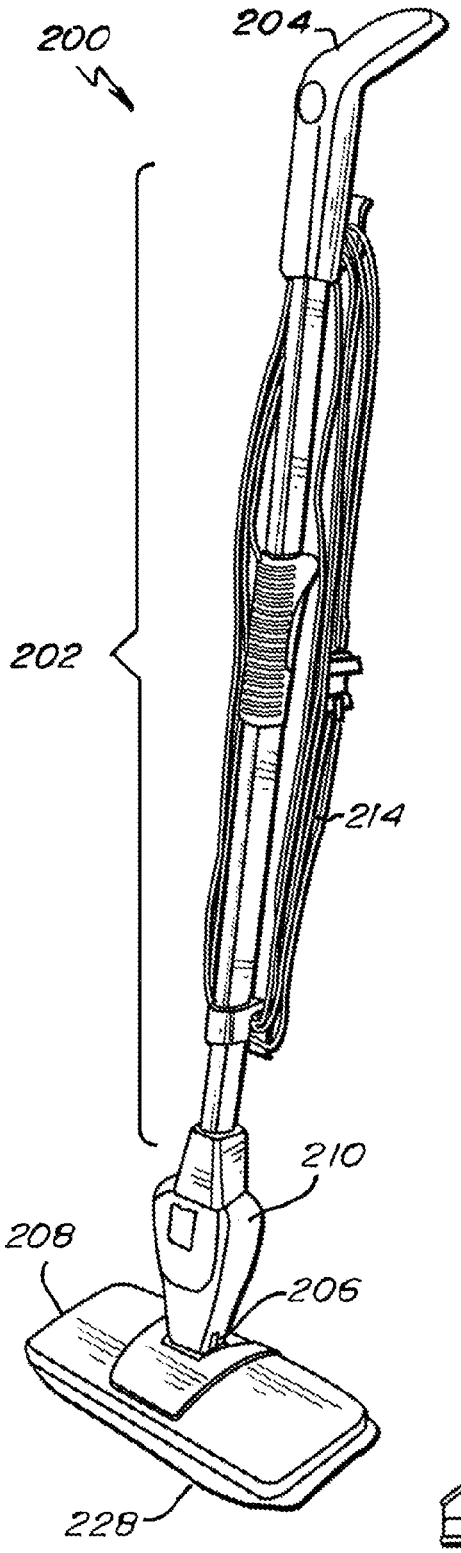
FIG. 1 shows a perspective view of a hot cleaning system according to a first exemplary embodiment of the invention.

FIGS. 1 though 11 show a first exemplary device in the form of a mopping apparatus 200 in which a cleaning pad 228 is moistened and heated to more effectively clean and sanitize a floor or other such surface.

Figure 2:
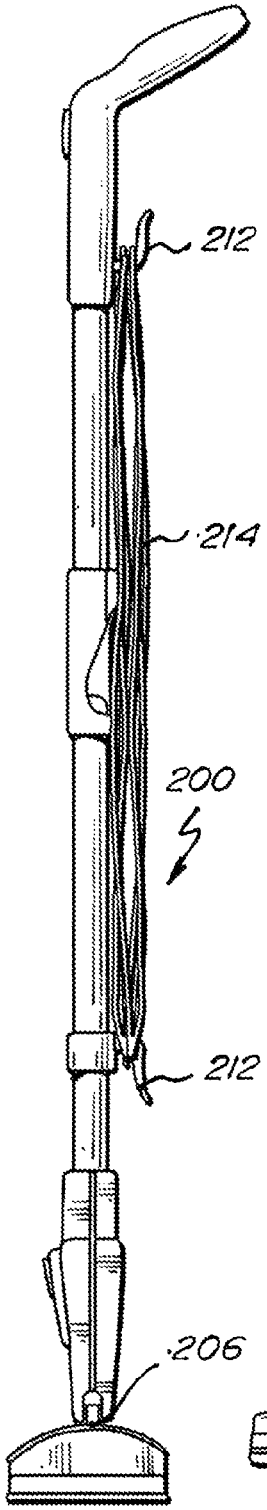
FIG. 2 shows a side view of the system of FIG. 1.
Figure 3:
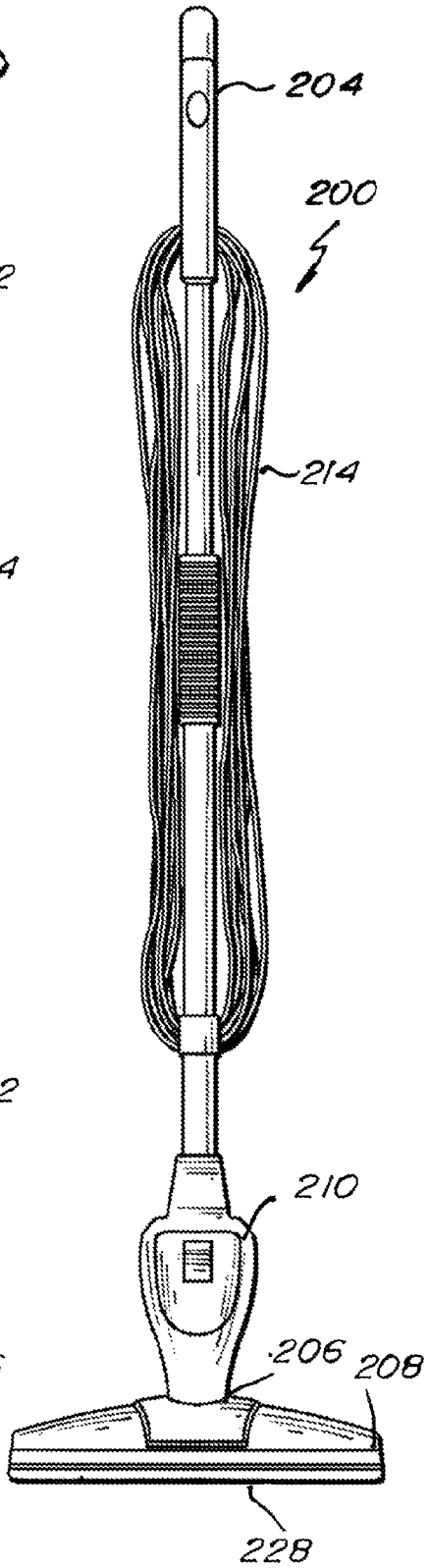
FIG. 3 shows a front view of the system of FIG. 1.

FIGS. 1 through 3 show that the mop includes an elongate body 202 having a handle 204 at its proximal (top) end and a hinge 206 at its distal (bottom) end to which is hingedly connected a cleaning head 208. The elongate body also includes a refillable water reservoir 210 and hooks 212 for securing a stored power cord 214.

Figure 4:
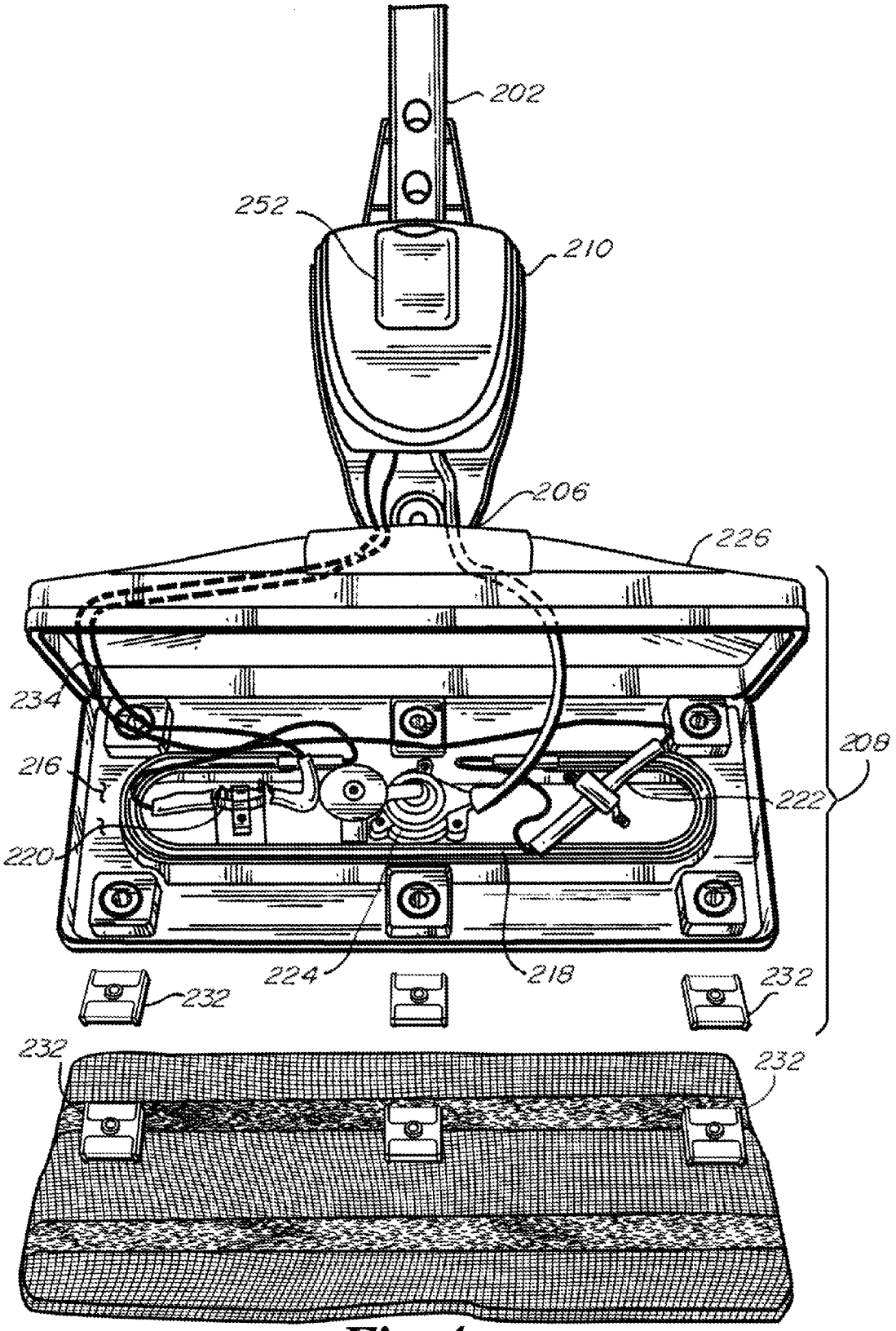
FIG. 4 shows a partially disassembled view of the head and tank portions of the system of FIG. 1.
Figure 5:
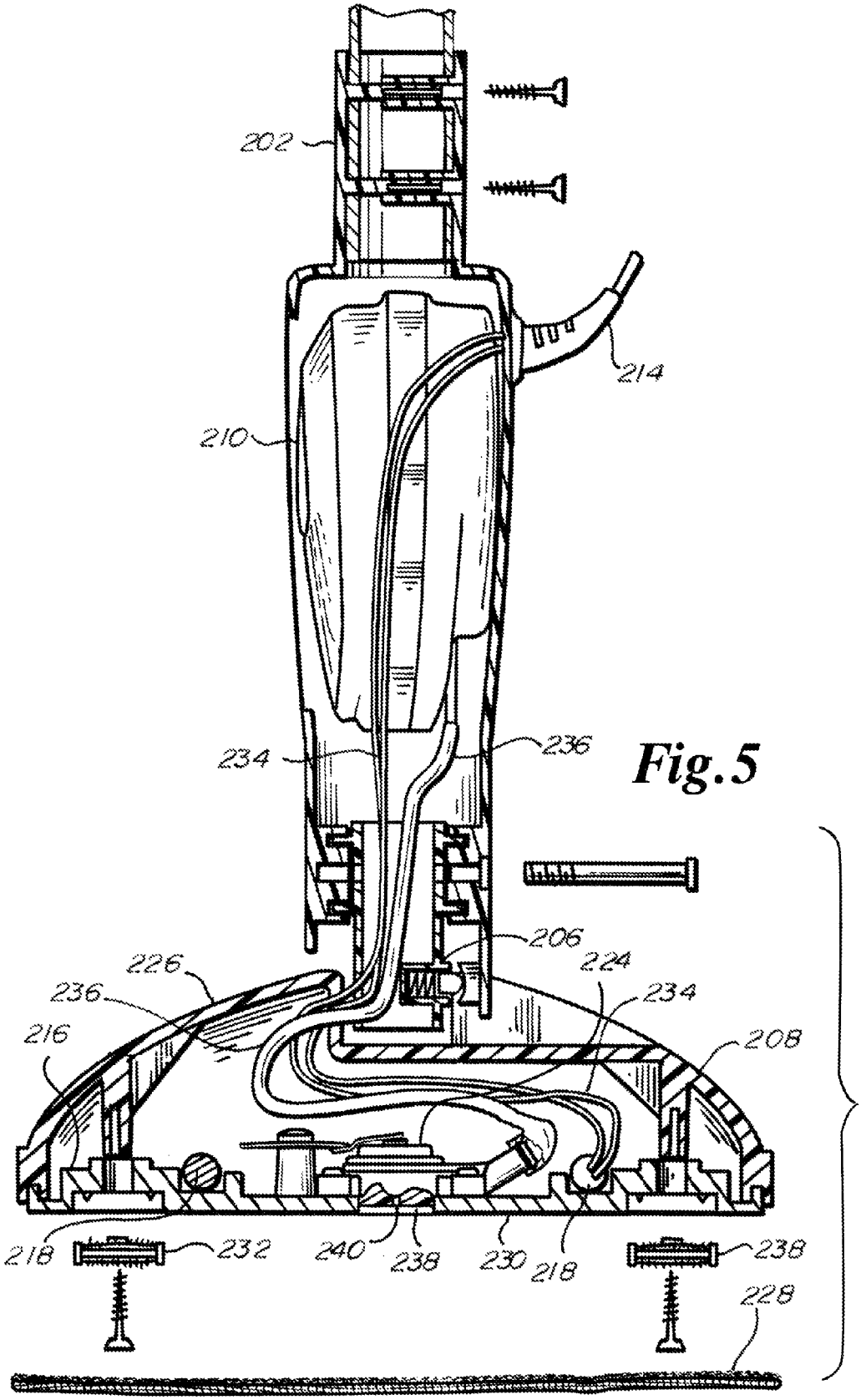
FIG. 5 shows a side cross section of the head and tank portions of the system of FIG. 1.

Referring next to FIG. 4, where cleaning head 208 is shown exploded and partially disassembled to afford a clear view of its components, and to FIG. 5, where the lower portion of the mopping apparatus is shown in cross section, it can be seen that the head includes a heating plate 216, a heating element 218, a thermostat 220, a thermo-fuse 222, a thermal valve 224, a cover 226, and a cleaning pad 228 which removably affixes to and against the planar underside 230 of the heating plate by means of hook/loop fasteners 232. The cleaning pad is preferably made of cotton for its optimal absorbency, heat tolerance, and wash-ability.

The heating plate is made of metal, preferably a highly thermally conductive metal such as aluminium, and preferably made by die-casting and machining. The heating element is preferably insert-cast into the heating plate to optimize heat transfer.

The configuration of the heating plate is such that heat from the heating element most efficiently conducts to the planar underside, and the thermostat and thermo-fuse most effectively monitor and react to the temperature of that flat underside. While water is selectively allowed to flow through the thermal valve and heating plate to moisten the cleaning pad, as will be later explained, the configuration of the heating plate is such that this water is not substantially heated and arrives at the cleaning pad at substantially its original temperature. This prevents scaling and mineral build-up that would otherwise cause blockages and require internal maintenance, especially for users in hard water areas. This also prevents the boiling of water within the heating plate which would otherwise cause the formation of steam and the adverse effects thereof, such as noise and spitting.

Electrical wires 234 facilitate the selective feeding of power from the power cord 214, through the hinge 206, thermostat 220, thermo-fuse 222, and to the heating element 218, when all of the thermostat, thermo-fuse, and an optional power switch (not shown) are electrically closed. The thermostat allows the heating element to continue heating the planar underside until it senses a temperature of 120 C, at which time it will open. It will close again once it senses a drop in the temperature to 90 C and will then continue to cycle on and off repeatedly to maintain the temperature between 90 C and 120 C. The thermo-fuse is a one-time safety device which will permanently open, disabling operation of the apparatus, if it senses an abnormally high temperature, indicating that the thermostat has failed. Preferable, the thermo-fuse will open at 170 C, requiring disposal or repair of the mopping apparatus.

Conduit tubing 236 provides a pathway for water from the water reservoir 210 to the thermal valve 224. The thermal valve is connected to a channel 238 on the planar underside 230 of heating plate which provides moisture to the cleaning pad. When the thermal valve is open, water is allowed to flow by gravity from the water reservoir to the channel to moisten the cleaning pad 228 affixed firmly and flatly there-against. The flow of water alternatively may be controlled by the addition of a trigger (not shown) at the handle to selectively actuate a supply valve to release water from the tank to the thermal valve. This trigger-actuated valve would be in fluid communication with the water reservoir and thermally-actuated valve to selectively allow or deny water from the water reservoir to the thermally-actuated valve. Or the water supply may alternatively be controlled by an electric pump in arrangements that cannot benefit adequately from the forces of gravity.

Figure 6:
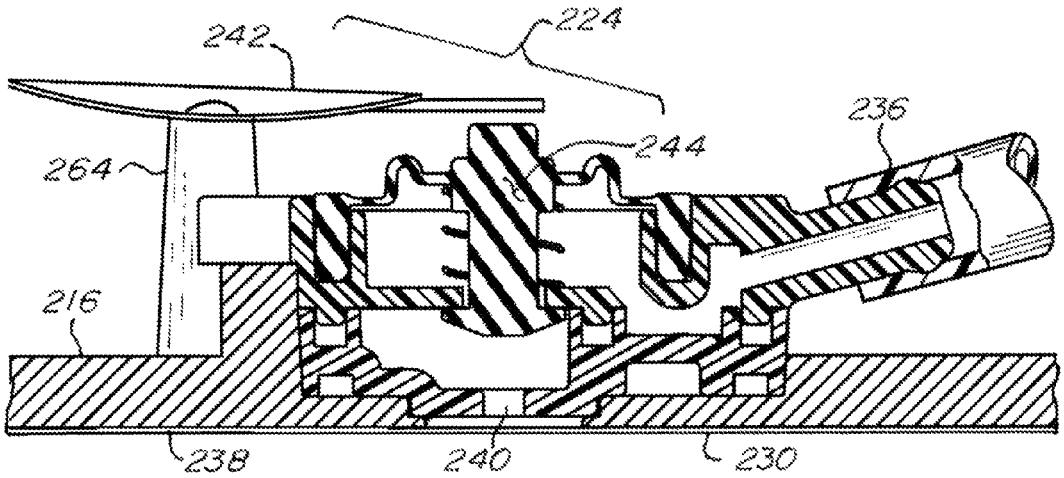
FIG. 6 shows a cross section of the thermal valve of the system of FIG. 1 in the closed position.
Figure 7:
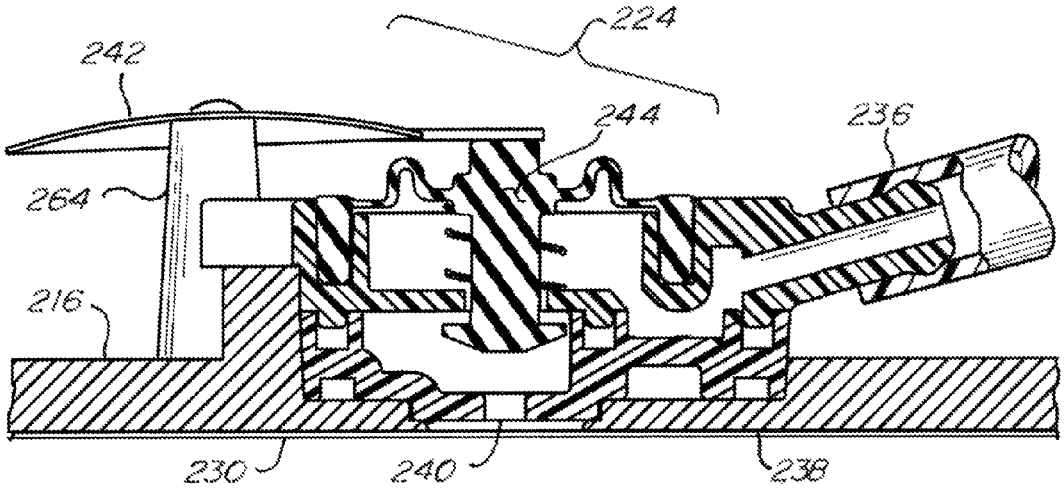
FIG. 7 shows a cross section of the thermal valve of the system of FIG. 1 in the opened position.

The thermal valve 224 is shown in cross section FIGS. 6 and 7. FIG. 6 shows the valve in its closed state and FIG. 7 shows it in its open state. The valve includes a bimetal "oilcan" element 242 which reverses shape form concave (FIG. 6) to convex (FIG. 7), when it is heated. This change in shape causes valve stem 244 to be depressed, opening a channel through the valve for the flow of water from the conduit tubing 236 to the channel 238.

Figure 11:
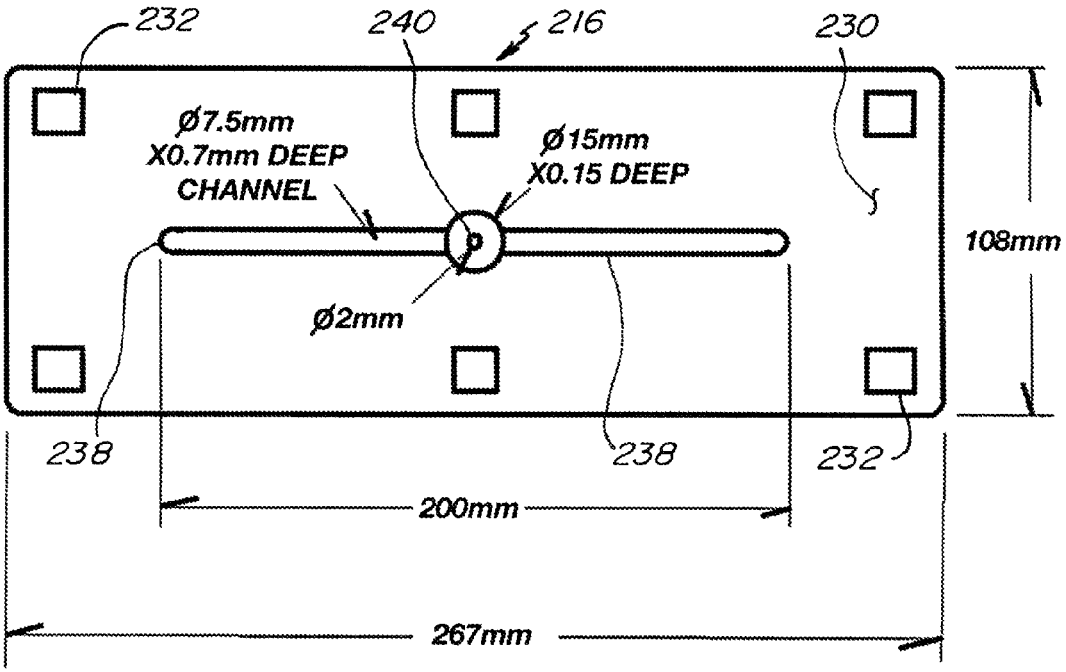
FIG. 11 is an underside view of the heating plate of the system of FIG. 1.

FIG. 11 is a view of the underside of the heating plate 216 where channel 238 can best be seen. In the exemplary embodiment, the planar underside 230 of the heating plate has a length of 267 mm and a width of 108 mm. Channel 238 has a diameter of 7.5 mm and a depth of 0.7 mm into the underside, which is found to be ideal for supplying moisture evenly across the cleaning pad. Hole 240 of the thermal valve is 2 mm in diameter, which is found to be ideally sized for supplying water to the channel at a rate equivalent to rate that moisture is lost from the cleaning plate during use.

Figure 8:
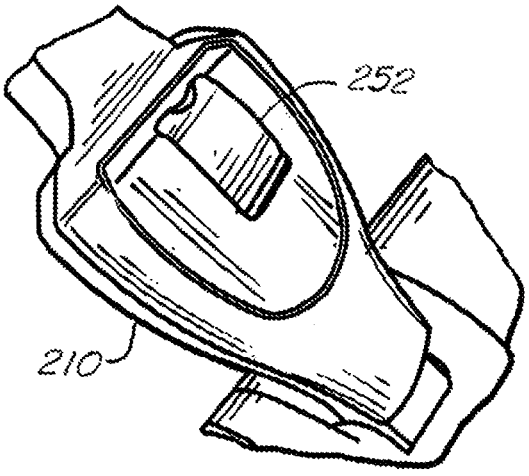
FIG. 8 shows the tank opening of the system of FIG. 1 in the closed position.
Figure 9:
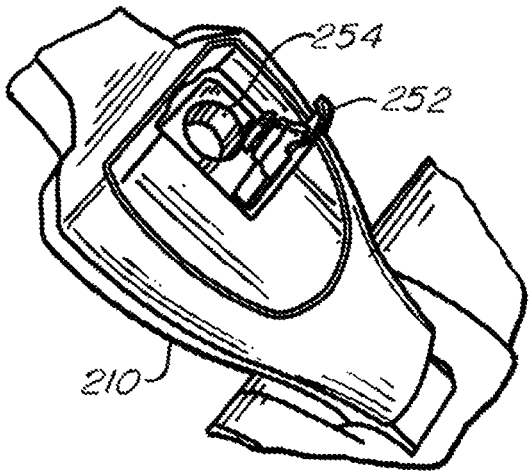
FIG. 9 shows the tank opening of the system of FIG. 1 in the opened position.
Figure 10:
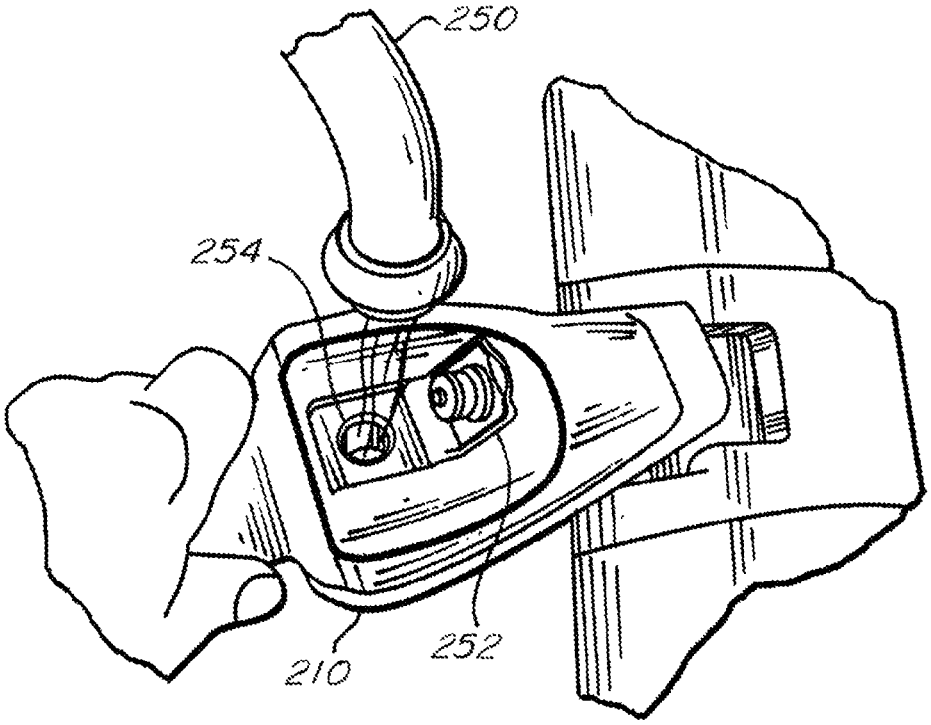
FIG. 10 shows the tank opening of the system of FIG. 1 during filling.

FIGS. 8 through 10 show how the water reservoir 210 is filled, such as at spigot 250. Cap 252 is first opened exposing fill hole 254. Water from the spigot it poured through the hole to fill the reservoir, and then cap is closed to seal the reservoir.

When initially energized, the water-filled apparatus begins a continuously cyclic electrical and fluid operation. Initially, cool water is held within the reservoir and within the conduit tubing and prevented from the channel by the closed thermal valve. The heating element is then energized. Because the bimetal element is rigidly fixed to a post 264 which is cast integrally of the heating plate, it immediately senses the rise in temperature of the planar underside caused by the energized heating element, and once that temperature reaches 85 C, it releases this cool water through hole 240 and channel 238 to moisten the cleaning pad. The thermal conductivity of this moisture speeds up the heating of the cleaning pad and ensures even heating across the pad.

Because the valve is disposed above ("before") the heating plate and because the channel is on the underside of ("after") the heating plate, no water is retained within the heating plate, and scaling, the mineral build-up and other reliability problems normally associated with such water heating is avoided. The heating element remains energized and the moistened cleaning pad continues to be further heated until the thermostat senses that the pad has reached 120 C.

The moisture within the cleaning pad is heated to 100 C, but cannot rise above that temperature as long as water continues to be fed through the channel. If continuously used, the water in the reservoir will continue to flow and will eventually run out. This will cause the cleaning pad to dry and the temperature of the planar underside to rise, which, once reaching 120 C, will open the thermostat and prevent further heating. Alternatively, if the heating element is manually de-energized prior to the emptying of the reservoir, such as by unplugging the power cord or opening a power switch, the temperature sensed by the bimetal valve will drop and cause the valve to close, thereby preventing unwanted leakage from the reservoir during non-use.

In actual use, it is found that the thermal valve and thermostat cycle open and closed repeatedly during use to feed moisture to the pad, heat the moisture, and repeat. At no time is the water heated to steam, and there is no spitting or spraying. The hole of the thermal valve and the channel found to remain clean and clear after extended usage.

The moistening of the pad is found to improve the interaction between the apparatus and the floor and reduce the effort required by the user. For instance, the mop is found to glide more smoothly over the floor as a result of its moist condition. And the lack of steam avoids the damage to hardwood floors and such. Because the pad is maintained in a hot and moist state, it leaves no puddles on the floor. The 100 C temperature and moisture is found ideal for loosening debris and dried foods without the adverse effects of steam-cleaning.

In alternative versions, the power cord may include an in-line power switch. The power cord may be detachable so that they user may use the apparatus for powerless cold mopping. Other anticipated alternatives include the absence of a water tank, thermal valve, and moistening channel in a version intended to be used with pre-moistened disposable cleaning pads. Still another anticipated alternative includes powering the device by disposable or rechargeable batteries. And still another anticipated alternative includes heating the heating plate by induction rather than by an embedded heating element. In this alternative, an external induction generator could include a bath for dipping the apparatus to wet the pad, and a charging area. The apparatus could thus be absent any power cord or batteries. The cleaning pad would be heated after it was wetted by placing the metallic heating pad adjacent the charging area, within the field of an induction coil in the generator, for a short period of time. The heating pad would stay hot and moist for a short while, then the wetting and heating steps would be repeated.

Referring next to FIGS. 12 through 28, a second embodiment is shown in the form of a mopping apparatus 300 including all of the features of mopping apparatus 200 above, but having additional features and components. Where not specifically described, the elements and features of this second embodiment are identical or equivalent to those of first embodiment 200. To simplify, item numbering for the second embodiment corresponds to that of the first embodiment, except that were 2—numbering was used for the first embodiment, 3—numbering is used for the second embodiment. For example, item 304 of the second embodiment is equivalent to item 204 of the first embodiment.

Figure 12:
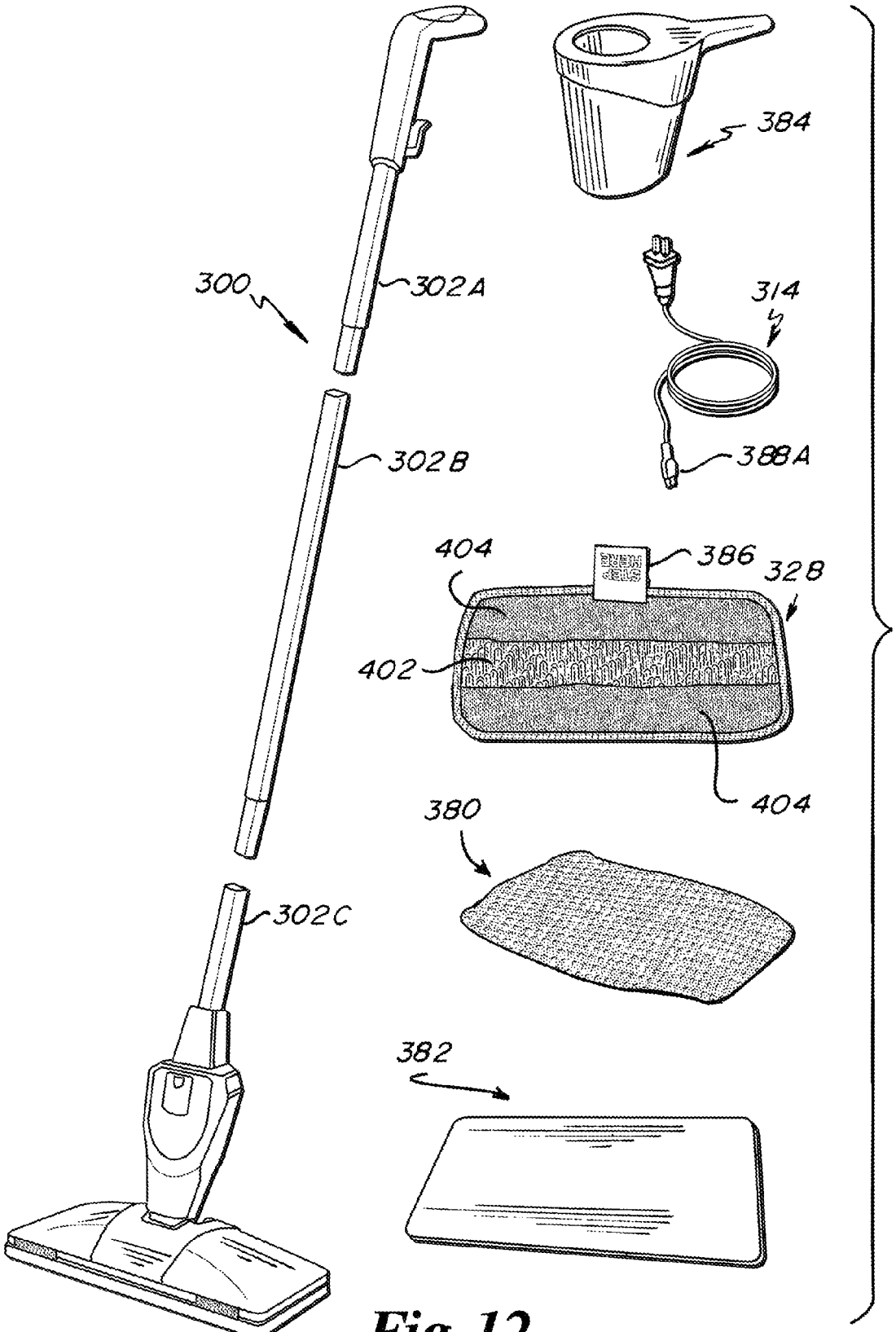
FIG. 12 is an exploded view of a hot cleaning system according to a second exemplary embodiment of the invention.
Figure 15:
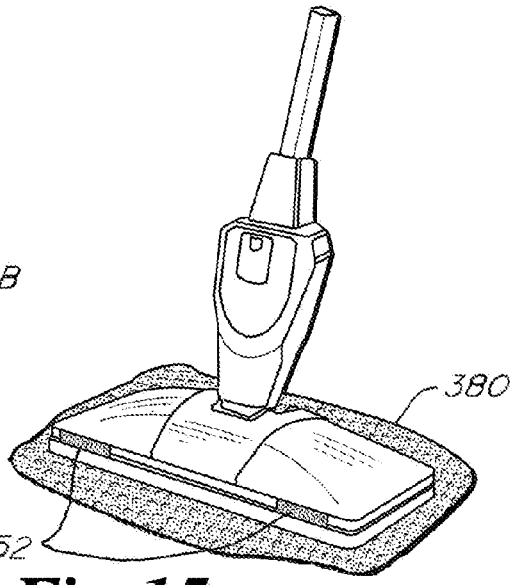
FIGS. 15 and 16 are perspective views of the attachment of the wipe of the system of FIG. 12.
Figure 16:
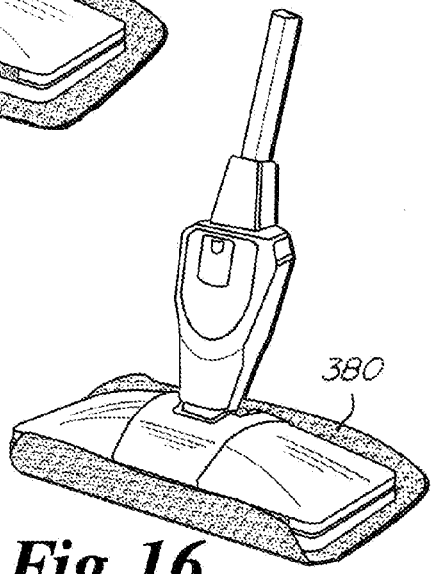
Figure 17:
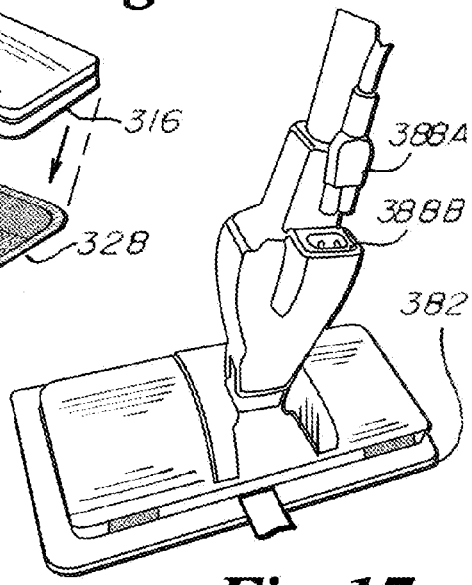
FIG. 17 is a perspective view of the attachment of the power cord of the system of FIG. 12.
Figure 18:
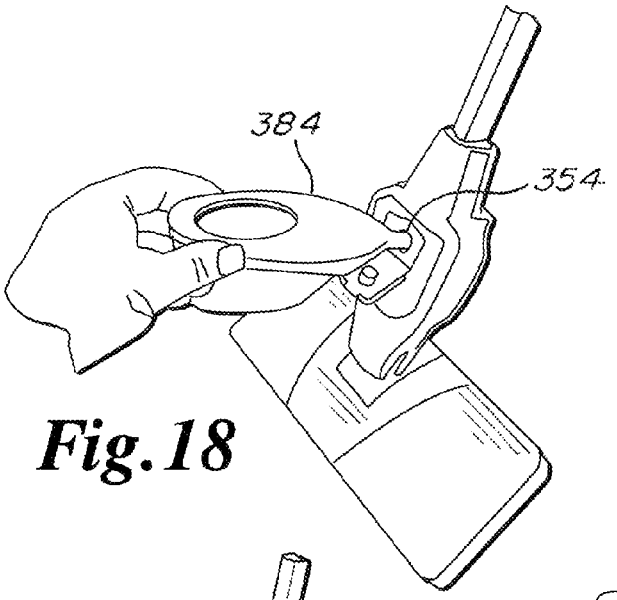
FIG. 18 is a perspective view of the filling of the water tank of the system of FIG. 12.
Figure 24:
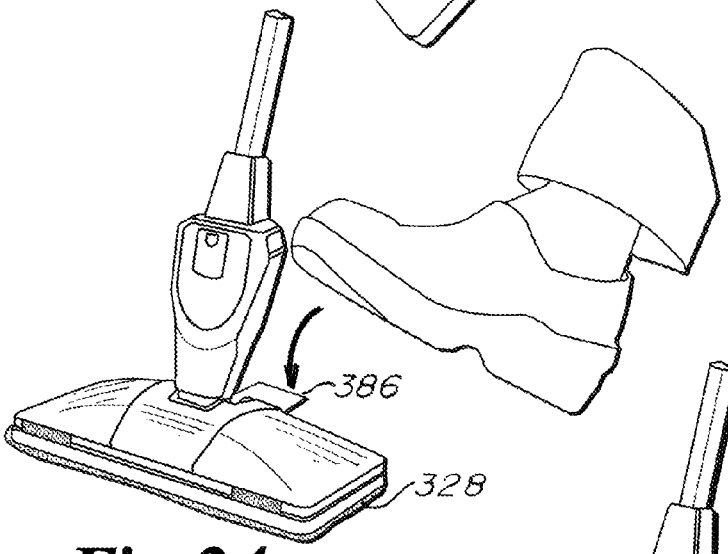
FIGS. 24 and 25 are perspective views of the removal of the cleaning pad of the system of FIG. 12.
Figure 25:
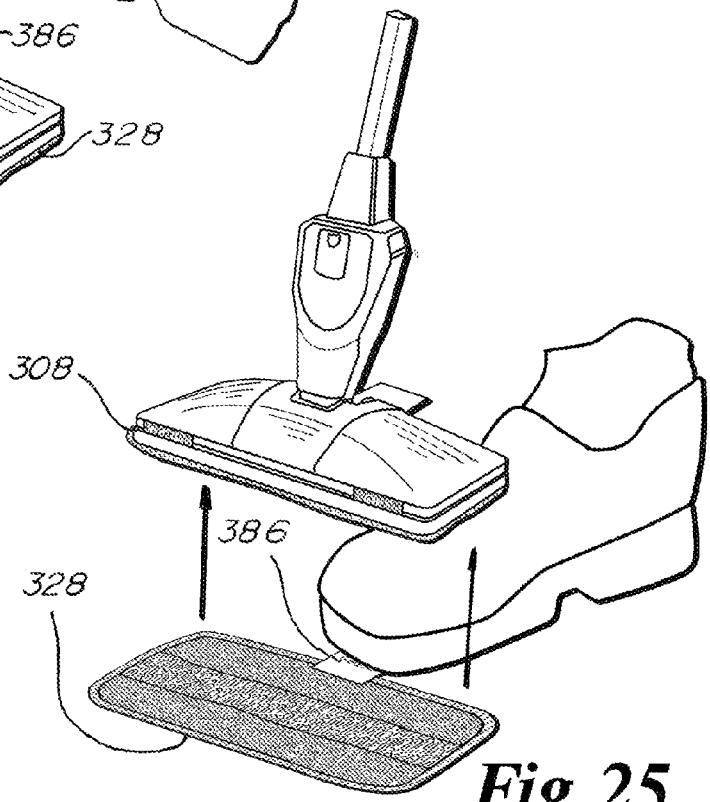
Figure 19:
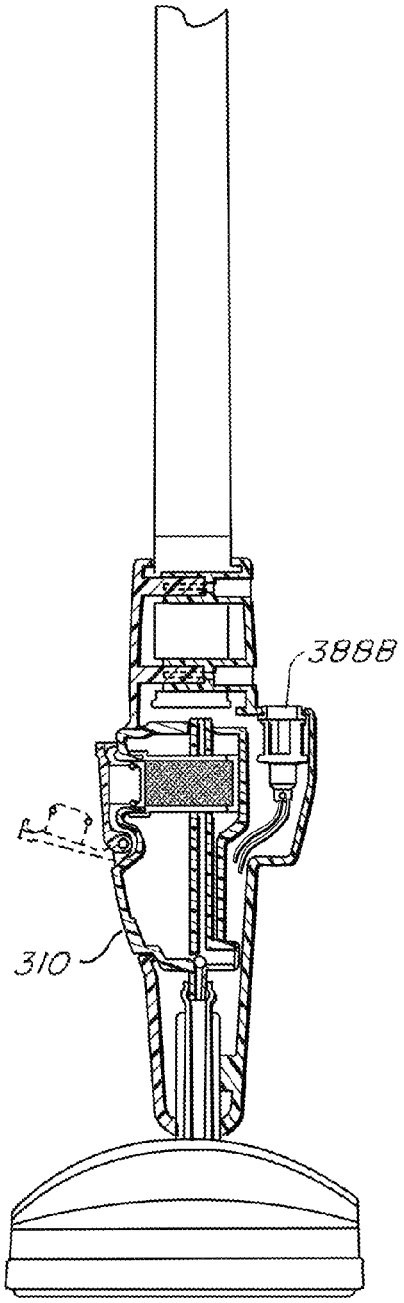
FIG. 19 is a partial cross section through the system of FIG. 12 in an upright "storage" position.
Figure 20:
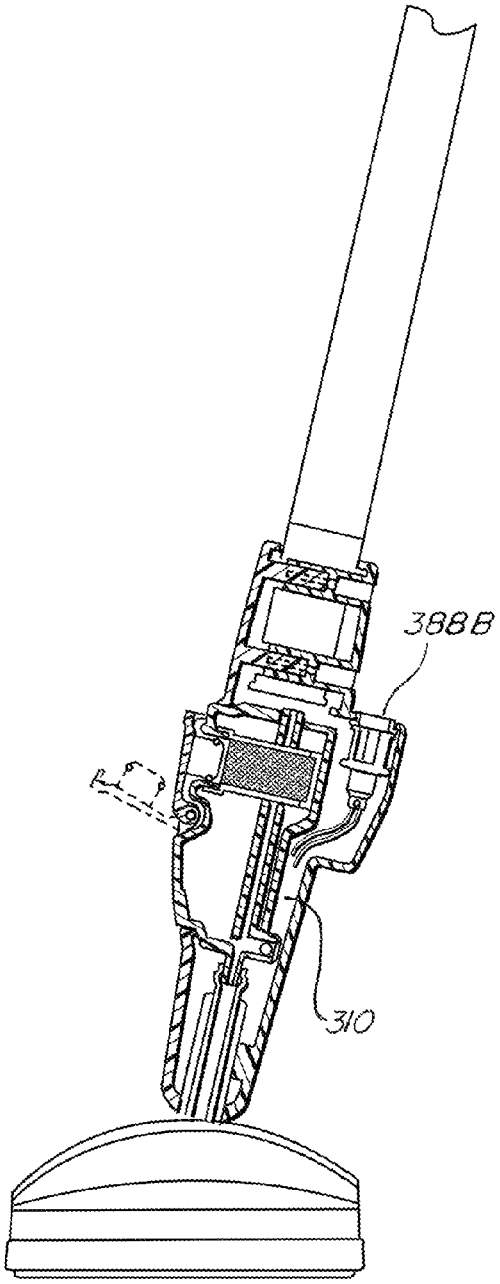
FIG. 20 is a partial cross section through the system of FIG. 12 in a tilted "usage" position.
Figure 21:
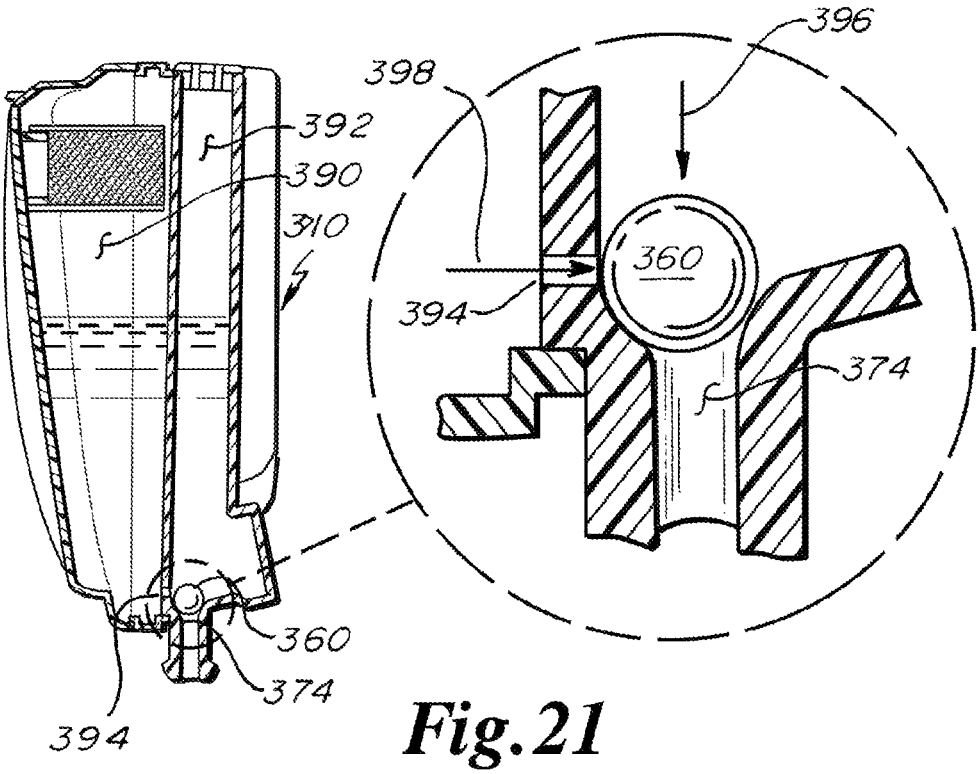
FIG. 21 is a cross section through the water tank of the system of FIG. 12 during the upright position shown in FIG. 19.

Referring to FIG. 12, mopping apparatus 300 is complimented by removable power cord 314, cleaning pad 328, wipe 380, resting pad 382, and pitcher 384. The cleaning pad is of a construction that attaches simply to the heating plate 316 on the underside of cleaning head 308, while optimally cooperating with the heating and moistening features of the cleaning head. The cleaning pad is equipped with a foot-operable tab 386 to ease removal from the cleaning head as shown in FIGS. 24 and 25. The wipe is an inexpensive and disposable under-wrap for complimenting and extending the life of and the cleaning pad, and is easily attached, detached, and replaced, as shown in FIGS. 15 and 16. The pitcher is an accessory to ease filling the water tank 310 at fill hole 354 as shown in FIG. 18. The power cord is easily attached and removed from the remainder of the mopping apparatus at connector 388A and 388B, as shown in FIG. 17, to enable the mopping apparatus to be used as a powerless wiping mop without encumbrance from the cord. The resting pad is an insulating and heat-tolerant pad atop of which the mopping apparatus may be placed while still hot but not currently in use, for safety and to protect the floor from burning.

Wipes 380 are larger in perimeter than cleaning pad 328 so that, as shown in FIGS. 15 and 16, the outwardly extending perimeter edges of the wipes may be wrapped upwardly around the cleaning pad and head 308 to engage hook/loop fasteners 352. The wipes are made of non-woven fabric which suitably temporarily adheres to the hook/loop fasteners. This material collects dust and lint and may be used without power cord 314, for cold and dry cleaning. Cleanings with only the wipes before wet mopping with the cleaning pad removes dust and dirt, to protect and extend the life of the cleaning pad. The wipes are very inexpensive, and typically, the user will replace the wipe after each use, but may reuse the cleaning pad many times.

Figure 13:
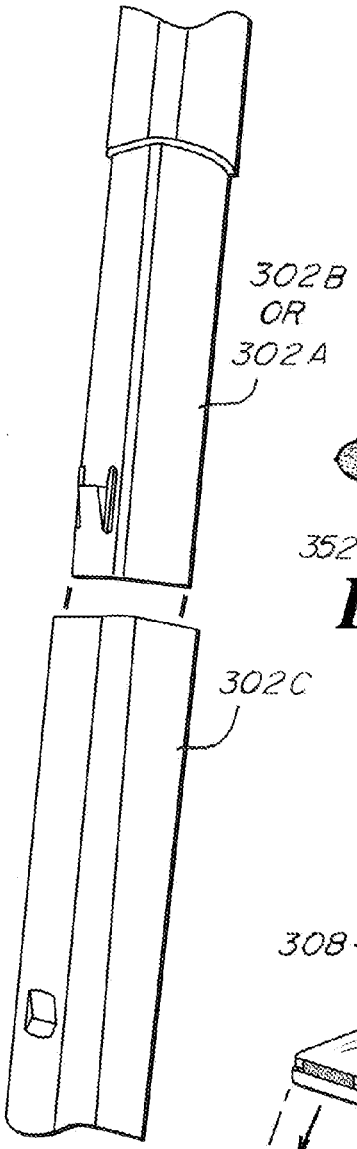
FIG. 13 is a perspective view of the assembly of the elongate body of the system of FIG. 12.
Figure 14:
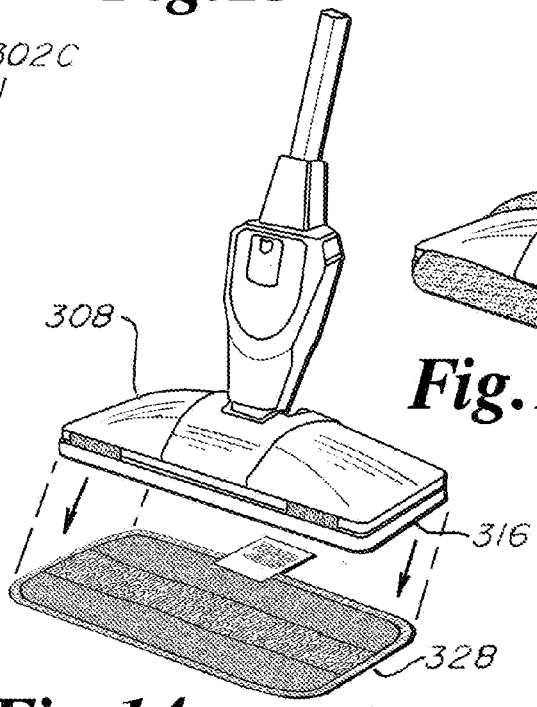
FIG. 14 is a perspective view of the attachment of the cleaning pad of the system of FIG. 12.

Prior to use, the mopping apparatus is assembled by connecting poles 300A, 300B, and 300C to form the elongate body, as shown in FIG. 13, the power cord is connected as shown in FIG. 17, the water tank is filled, as shown in FIG. 18, and cleaning pad and wipe are attached, as shown in FIGS. 14-16. The mopping apparatus may now be used in accordance with the above-disclosure for the first embodiment.

Referring to FIGS. 19 through 23, a gravity-induced valve arrangement within water reservoir 310 for preventing inadvertent water leakage from mopping apparatus 300 during storage is shown. The valve arrangement is incorporated into the water reservoir, and comprises a heavy metal ball 360 that interfaces with the reservoir to either deny or allow stored water 364 to the mop's head 308. When the mop is in its storage configuration shown in FIGS. 19 and 21, with tank 310 in a vertical orientation, gravity causes the heavy ball to rest on and seal the tank outlet hole 374.

The tank includes two water-holding chambers, main chamber 390 and vented chamber 392, with chamber port 394 providing communication there-between. The chamber port is adjacent the metal ball. During the upright position of FIG. 21, the weight of the stored water in the vented chamber causes a force vector 396 that acts straight downwardly on the ball to assist sealing. During this position, the side-acting force vector 398 caused by the water in the main chamber is insignificant in comparison to the downwardly-directed force vector 396 from the vented chamber, so the ball is influenced to remain firmly in sealing engagement with hole 374. Since this is the recommended and usual storage position for the mopping apparatus (such as when stood in a storage closet), this prevents the water from inadvertently escaping the water take during storage.

Figure 22:
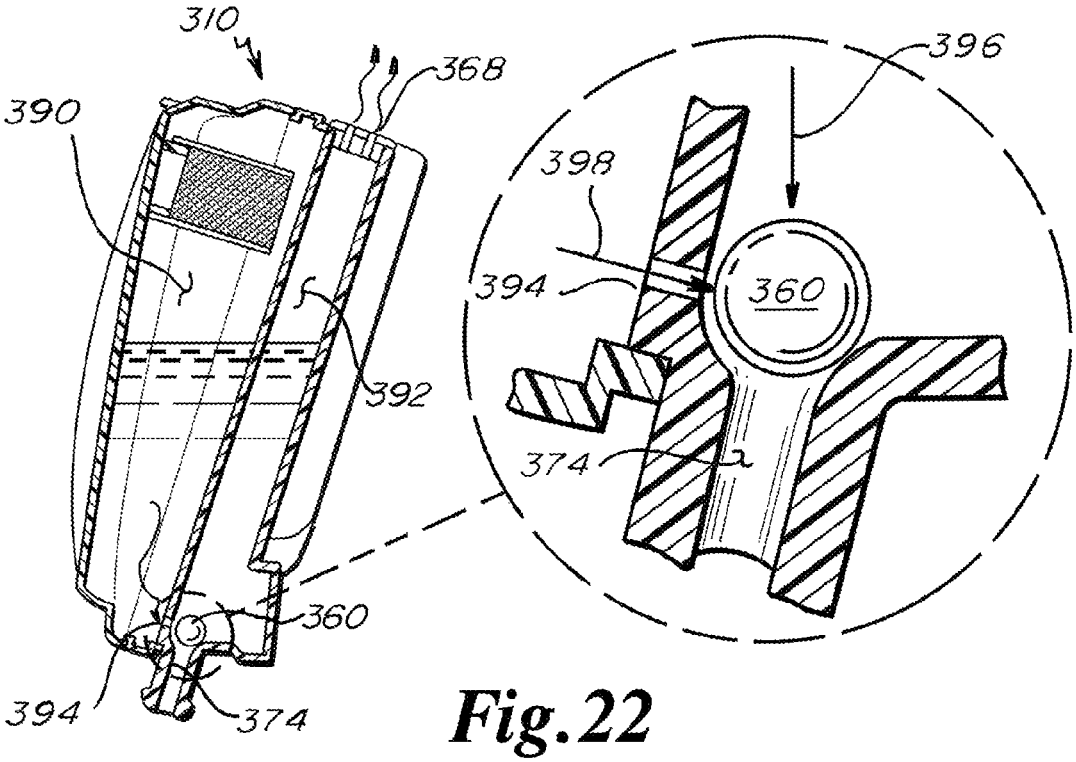
FIG. 22 is a cross section through the water tank of FIG. 21 at the critical tipping point between the upright position shown in FIG. 19 and the tilted position shown in FIG. 20.
Figure 23:
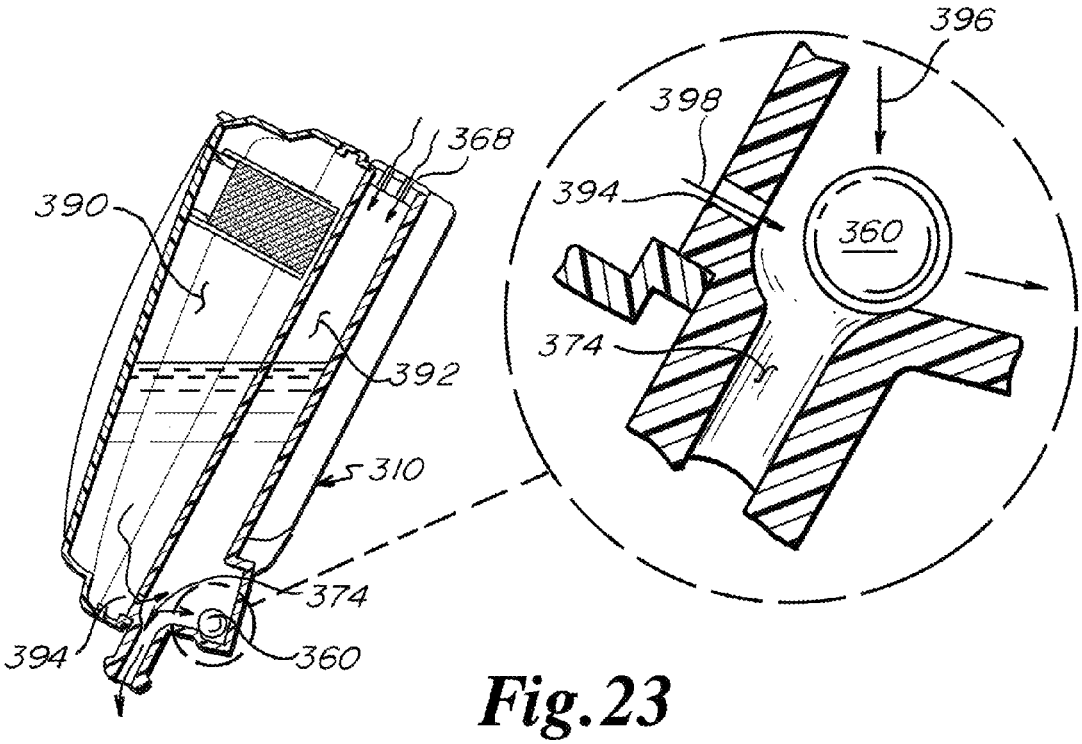
FIG. 23 is a cross section through the water tank of FIG. 21 during the tilted position of FIG. 20.

As the handle portion of the mopping apparatus is first tipped, such as at the commencement of use, the balance between the downwardly-directed forces of vectors 396 an 398 shift, and as the tank reaches the critical tipping angle shown in FIG. 22, the forces from the main chamber and the forces from the vented chamber equalize. Further tilting of the tank causes the ball to be quickly pushed off of hole 374 by vector 398, allowing water from the main chamber to flow out of the tank through port 394 and outlet hole 374 when allowed to do so by the valving in the mopping head as in the previous embodiment.

Vent 368 enables air to leave the vented chamber as the tank is initially tilted and enables air to enter the tank so the water may flow out.

Figure 27:
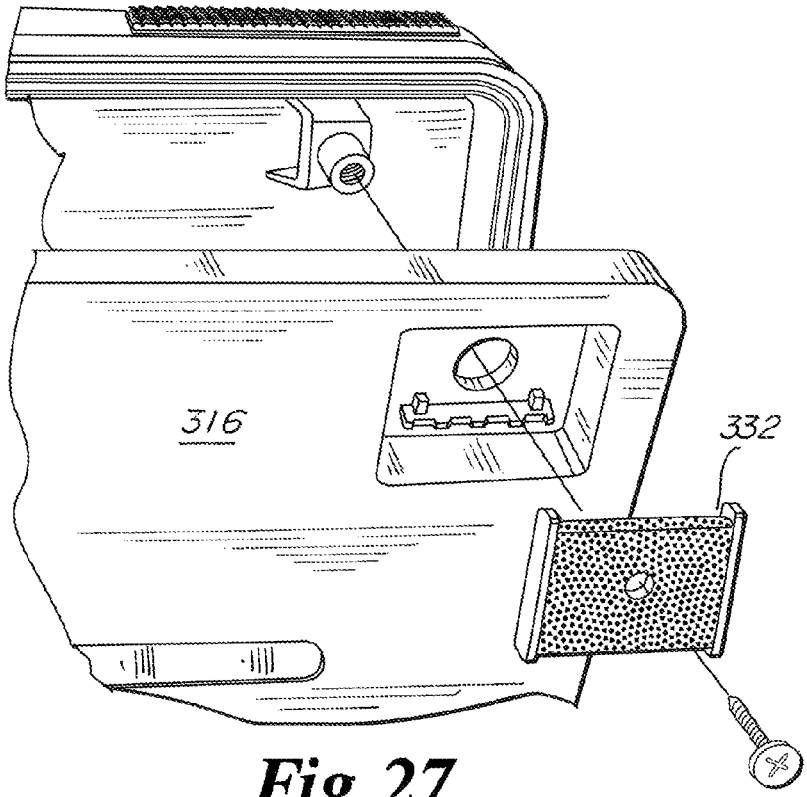
FIG. 27 is an exploded view of the attachment of the cleaning pad fastener of FIG. 26.
Figure 26:
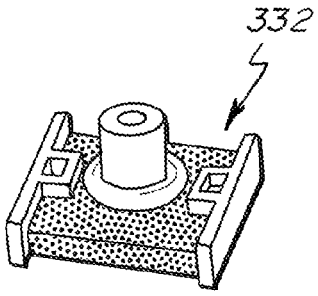
FIG. 26 is a perspective view of a cleaning pad fastener of the system of FIG. 12.

Referring to FIG. 12, cleaning pad 328 has a central strip of water absorbent material 402 within two outer strips of hook/loop fabric 404. The central strip aligns with the channel on the underside of the heating plate when the cleaning pad is in place, and the hook/loop fabric strips engage the hook/loop fasteners 332 which are attached peripherally to the underside of the heating plate, as seen in FIGS. 26 and 27. The pad may alternatively be affixed to the underside of the heating plate by other common means, such as snap fasteners, magnetic fasteners, or temporary adhesives such as "sticky tack".

The cleaning pad also has an outwardly extending tab 386 to ease its removal from the heating plate and hook/loop fasteners, as shown in FIGS. 24 and 25. The user simply presses his foot down on the tab and pulls the mopping apparatus upward to peel the pad off of the heating plate. This avoids touching the wet, dirty, and possibly hot pad, avoids bending down to reach it, and improves removal leverage. The tab is preferably of a non-absorbent material so that it stays dry while the remainder of the pad is moistened, so that the user does not need to touch any of the moist portion of the pad when removing it.

Figure 28:
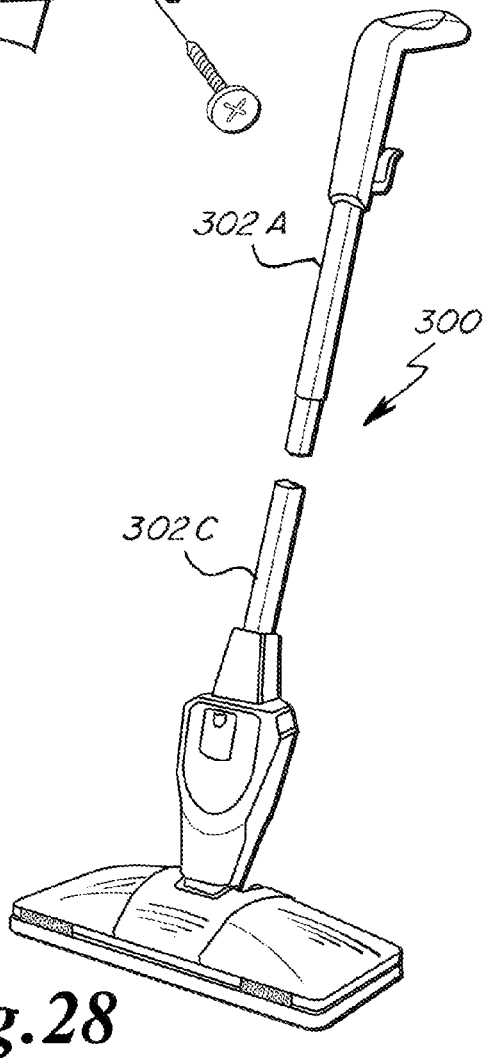
FIG. 28 is a perspective view of the system of FIG. 12 in a shortened configuration.

FIG. 28 shows that mopping apparatus 300 may be used in a shortened configuration simply by removing the central portion 302B of the elongate body and using only portions 302A and 302C, which are similarly connectable as shown in FIG. 13.

While the invention has been shown and described with reference to specific exemplary embodiments, it should be understood by those skilled in the art that various changes in form and detail may be made without departing from the spirit and scope of the invention, and that the invention should therefore only be limited according to the following claims, including all equivalent interpretation to which they are entitled.

We claim:

1. An apparatus for horizontal surface cleaning, comprising;

a tank adapted for containing a surface cleaning liquid and having an upright orientation during storage and a tilted orientation during horizontal surface cleaning, and a gravity-actuated valve cooperating with the tank to prevent the liquid from exiting the tank during the upright orientation and allowing the liquid to exit the tank during the tilted orientation; wherein horizontal surface cleaning requires the tank to assume the tilted orientation.

2. The apparatus of claim 1 further comprising a power cord detachable from the apparatus, a cleaning head having a heating plate, and a cleaning pad; wherein the heating plate forms a planar underside of the cleaning head and includes a heating element to heat the planar underside when the power cord energizes the heating element;

the cleaning pad is removably attached against and in thermal communication with the planar underside such that the cleaning pad is heated to a temperature between 85 C and 100 C, inclusive, when the power cord energizes the heating element; and the heating element does not heat the planar underside and the cleaning pad is not heated whenever the power cord is detached from the apparatus.

3. The apparatus of claim 2 wherein the cleaning pad is a fabric pad.

4. The apparatus of claim 2 wherein the cleaning head comprises the heating plate and the cleaning pad, and wherein the apparatus further comprises an elongate body comprising a handle at a proximal end thereof, wherein the cleaning head is flexibly disposed at a distal end of the elongate body, and wherein the elongate body is tilted during horizontal surface cleaning.

5. An apparatus for horizontal surface cleaning, comprising;

a cleaning head for engaging horizontal surfaces to be cleaned;

a handle pivotally engaging the cleaning head for grasping during horizontal surface cleaning;

a tank affixed to the handle and pivotal therewith relative to the cleaning head, the tank adapted to contain a surface cleaning liquid; wherein the handle and tank have together an upright orientation during storage and a tilted orientation during horizontal surface cleaning, and the tank comprises a valve that closes during the upright orientation to prevent the liquid from exiting the tank, and opens during the tilted orientation to allow the liquid to exit the tank; and wherein the tilted orientation is caused during horizontal surface cleaning.

6. The apparatus of claim 5, wherein the cleaning head comprises a heating plate and a cleaning pad; wherein the heating plate forms a planar underside of the cleaning head and includes a heating element to heat the planar underside;

the tank is adapted to selectively moisten the cleaning pad when the planar underside is above approximately 85 C;

the cleaning pad is removably attached against and in thermal communication with the planar underside such that the cleaning pad is moistened and heated to a temperature between 85 C and 100 C, inclusive; and the heating plate does not substantially heat water from the tank prior to the moistening of the cleaning pad.

7. The apparatus of claim 6 further comprising a thermally-actuated valve to control the moistening of the cleaning pad by the tank.

8. The apparatus of claim 7 wherein the thermally actuated valve is configured to open at approximately 85 C or above to allow water from the tank to the cleaning pad.

9. The apparatus of claim 8 wherein the thermally actuated valve comprises:

a valve stem having an open position for allowing water from the tank to the cleaning pad, and a closed position for denying water from the tank to the cleaning pad, and a bimetal actuator which changes shape according to temperature change and moves the valve stem between the open and closed positions accordingly.

10. The apparatus of claim 9 further comprising an elongate body comprising the handle at a proximal end thereof, wherein the cleaning head is flexibly disposed at a distal end of the elongate body.

11. The apparatus of claim 10 wherein the tank is disposed on the elongate body above the cleaning head, and is adapted to moisten the cleaning pad by gravitational force when the valve stem is in the open position and the tank and handle are in the tilted orientation.

12. The apparatus of claim 11 further comprising a thermostat electrically connected to the heating element and adapted for sensing the temperature of the planar underside to maintain the temperature of the cleaning pad between 85 C and 100 C, inclusive.

13. The apparatus of claim 12 further comprising a thermo-fuse electrically connected to the heating element and adapted for sensing the temperature of the planar underside to disable the apparatus when an abnormally high temperature is sensed.

* * * * *